United States Patent [19]

Kawai

[11] Patent Number: 4,850,855

[45] Date of Patent: Jul. 25, 1989

[54] COMBUSTION CYLINDER STRUCTURE FOR OIL BURNER

[75] Inventor: Takashi Kawai, Aichi, Japan

[73] Assignee: Toyotomi Kogyo Co., Ltd., Japan

[21] Appl. No.: 226,093

[22] Filed: Jul. 29, 1988

[30] Foreign Application Priority Data

Jul. 31, 1987 [JP] Japan ..... 62-118304

[51] Int. Cl.[4] ..... F23D 5/00

[52] U.S. Cl. ..... 431/201; 126/96; 431/311; 431/312; 431/314

[58] Field of Search ..... 126/95, 96; 431/200, 431/201, 309, 311, 312, 313, 314, 320

[56] References Cited

U.S. PATENT DOCUMENTS 4,626,197 12/1986 Kumazawa et al. ..... 126/96 X
4,666,398 5/1987 Kumazawa et al. ..... 431/201
4,714,426 12/1987 Nakanishi et al. ..... 126/96 X
4,790,746 12/1988 Uno et al. ..... 431/310 X

FOREIGN PATENT DOCUMENTS 15254 7/1962 Japan .
50244 11/1981 Japan .
13449 4/1984 Japan .

*Primary Examiner*—Randall L. Green
*Attorney, Agent, or Firm*—Pollock, Vande Sande & Priddy

[57] ABSTRACT

A combustion cylinder structure for an oil burner capable of uniformly red-heating an upper portion of upper and lower cylindrical members as well as the remaining part of the members and exhibiting good aesthetic characteristics during combustion operation. The outer cylindrical member is arranged so as to terminate at an upper end thereof below upper ends of the inner cylindrical member and a heat-permeable cylinder and a dish-like inner top plate is formed into a diameter large sufficiently to cause its outer peripheral end to outwardly extend from the inner cylindrical member to the position above the space. Also, the inner cylindrical member is formed at its upper portion opposite to the inner top plate with the vent holes. Also, the inner cylindrical member is formed at its upper portion opposite to the inner top plate with the vent holes.

11 Claims, 2 Drawing Sheets

COMBUSTION CYLINDER STRUCTURE FOR OIL BURNER

BACKGROUND OF THE INVENTION

1. Field of the Invention

This invention relates to a combustion cylinder structure for an oil burner, and more particularly to a combustion cylinder structure for an oil fired space heater of the type for radiating heat rays.

2. Description of the Prior Art

In the past, heat radiation from a combustion cylinder structure of an oil burner was carried out by red-heating a hemispherical wire mesh and/or a metal coil arranged on a top of the combustion cylinder structure by means of combustion heat produced in the structure and outwardly directly discharging heat rays emitted from the red-heated mesh and coil. Recently, however, it has been carried out by red-heating inner and outer perforated cylindrical members of the combustion cylinder structure between which fuel oil gas is thermally decomposed into combustible gas and outwardly discharging heat rays emitted from the red-heated cylindrical members through an outermost heat-permeable cylinder, as disclosed in Japanese Utility Model Publication No. 15254/1962, Japanese Utility Model Publication No. 50244/1981 and Japanese Utility Model Publication No. 13449/1984. In order to improve red-heating of the inner and outer cylindrical members, a part of through-holes of the outer cylindrical member is enlarged to cause combustion to be carried out on an outside of the outer cylindrical member as well as in a space between both cylindrical members. However, such construction, when combined with the wire mesh and/or metal coil described above, fails to satisfactorily red-heat them because of deteriorating function of discharging combustion gas from the combustion cylinder structure, accordingly, such wire mesh and metal coil are generally eliminated from the combustion cylinder structure.

Further, the combustion cylinder structure fails to sufficiently red-heat an upper portion of each of the inner and outer cylindrical members although a middle portion of each member is effectively red-heated, so that combustion efficiency is highly deteriorated. Also, This causes the upper portion of the structure to be seen blackishly, resulting aesthetic characteristics of the structure during combustion operation being deteriorated.

Accordingly, it would be highly desirable to develop a combustion cylinder structure for an oil burner which is capable of uniformly red-heating an upper portion of upper and lower cylindrical members of the structure as well as the remaining part of the members and exhibiting good aesthetic characteristics during combustion operation.

SUMMARY OF THE INVENTION

Generally speaking, in accordance with the present invention, a combustion cylinder structure is provided. The combustion cylinder structure includes a double combustion cylinder comprising an inner perforated cylindrical member and an outer perforated cylindrical member substantially concentrically arranged so as to define a first space therebetween and red-heated during combustion operation of the oil burner and an outermost cylinder arranged so as to surround the outer cylindrical member through a second space defined therebetween and compressing a heat-permeable cylinder constituting middle and upper sections of the outermost cylinder and a heat-impermeable cylinder constituting a lower section of the outermost cylinder. The heat-permeable cylinder is adapted to outwardly discharge heat rays emitted from the double combustion cylinder red-heated. The combustion cylinder structure also includes an inner top plate of a circular shape having a diameter larger than that of the inner cylindrical member and mounted on an upper end of the inner cylindrical member so as to outwardly extend at an outer periphery thereof from the inner cylindrical member. The outer periphery of the inner top plate preferably terminates at a position above the first space between the inner cylindrical member and the outer cylindrical member. The inner top plate is formed into a dish-like shape so as to have a peripheral section and a central section lower than the peripheral section. The outer cylindrical member has an upper end terminating at a position below upper ends of the inner cylindrical member and outermost cylinder. Further, the structure includes an outer top plate of an annular shape mounted on the upper end of the outer cylindrical member so as to extend from the outer cylindrical member to the outermost cylinder. The inner cylindrical member is densely or closely formed with a plurality of vent holes at a section thereof ranging from a portion of the inner top plate mounted at the inner cylindrical member to the central section of the inner top plate. The outer top plate is formed at a portion thereof between the outer cylindrical member and the outermost cylinder with a plurality of through-holes.

Accordingly, it is an object of the present invention to provide a combustion cylinder structure for an oil burner which is capable of uniformly red-heating inner and outer cylindrical members of the structure to improve combustion efficiency.

It is another object of the present invention to provide a combustion cylinder structure for an oil burner which is capable of exhibiting aesthetic characteristics during combustion operation.

It is a further object of the present invention to provide a combustion cylinder structure for an oil burner which is capable of uniformly red-heating inner and outer cylindrical members of the structure.

It is still another object of the present invention to provide a combustion cylinder structure for an oil burner which is capable of accomplishing the above-described object with a simple construction.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings in which like reference numerals designate like parts throughout, wherein.

DETAILED DESCRIPTION OF THE PREFERRED EMBODIMENT

Now, a combustion cylinder structure for an oil burner according to the present invention will be described with reference to the accompanying drawings.

Figure 1:
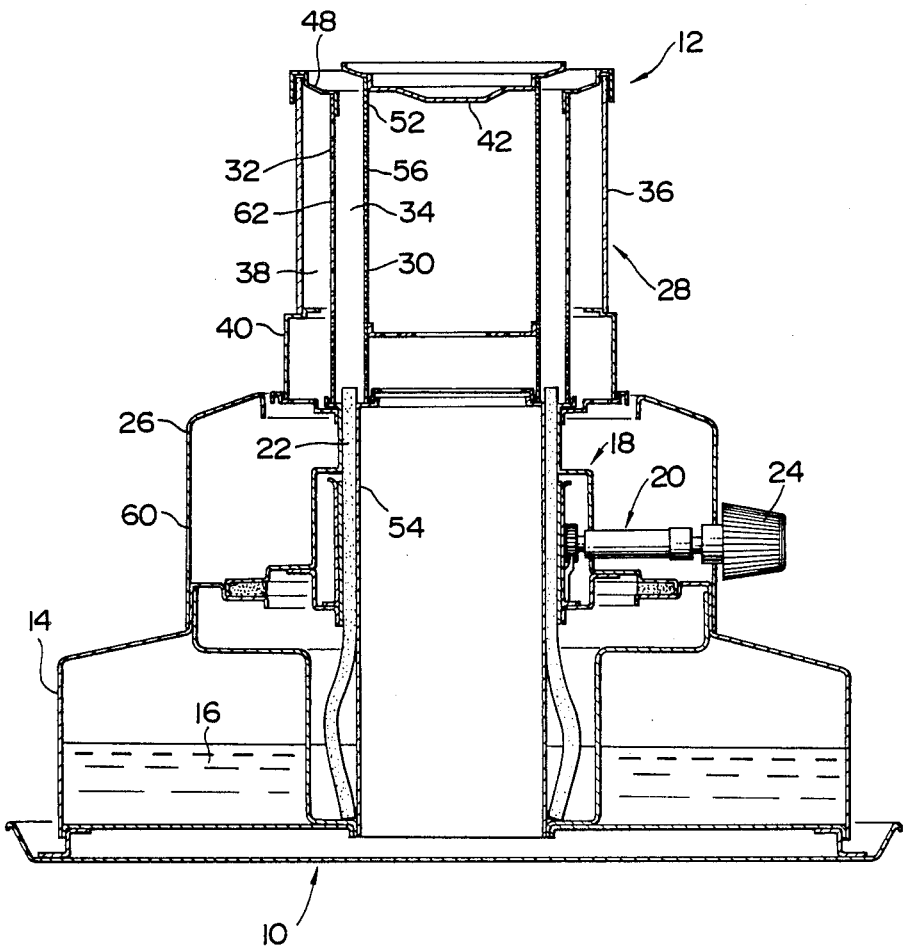
FIG. 1 is a schematic vertical sectional view showing an example of an oil burner which is adapted to incorporate a combustion cylinder structure according to the present invention therein.

FIG. 1 illustrates an example of an oil burner of the heat radiation type which is adapted to incorporate a combustion cylinder structure according to the present invention therein. The oil burner shown in FIG. 1 is in the form of a red-hot type oil fired space heater.

The oil burner generally designated by reference numeral 10 in FIG. 1 is constructed in such a manner as widely known in the art, except a combustion cylinder structure of the present invention generally indicated by reference numeral 12.

The oil burner 10 includes an oil reservoir 14 for storing fuel oil 16 such as kerosene therein and a wick receiving cylinder structure 18 communicated with the oil reservoir 14. At the wick receiving cylinder structure 18 is provided a wick driving mechanism 20 which is adapted to vertically move a wick 22 received in the wick receiving cylinder structure 18 through a knob 24. The wick receiving cylinder structure 18 and wick driving mechanism 20 are housed in a cylindrical casing 26 arranged between the oil reservoir 14 and the combustion cylinder structure 12.

The combustion cylinder structure 12 of the illustrated embodiment is arranged on the wick receiving cylinder structure 18. The combustion cylinder construction 12 includes a multiple combustion cylinder including an inner cylindrical member 30 and an outer cylindrical member 32 concentrically arranged so as to define a first space 34 therebetween. The inner cylindrical member 30 and outer cylindrical member 32 constitute a double combustion cylinder. The multiple combustion cylinder 28 also includes a heat-permeable cylinder 36 arranged so as to surround upper and middle sections of the outer cylindrical member 32 through a second space 38 defined therebetween. The heat-permeable cylinder 36 is supported on a heat-impermeable base cylinder 40 arranged on the wick receiving cylinder structure 18 so as to spacedly surround a lower section of the outer cylindrical member 32. The cylinder 40 may be made of a metal material. The heat-permeable cylinder 36 and heat-impermeable cylinder 40 constitute an outermost cylinder.

On a top of the inner cylindrical member 30 is mounted an inner top plate 42. The inner top plate 42 is formed into a dish-like shape which has a diameter larger than that of the inner cylindrical member 30 so that it outwardly extends by a distance from the inner cylindrical member 30 to a position above the first space 34. The inner top plate 42 is so formed that its central section 44 is depressed from or lower than its peripheral section 46, so that the central section 44 is positioned below the upper end of the inner cylindrical member 30. The inner top plate 42 may be made by pressing of a metal plate and fixed on the inner cylindrical member 30 by spot welding.

The combustion cylinder structure 12 of the illustrated embodiment is provided above the inner top plate 42 with no members such as an air regulating plate and the like as seen in the conventional combustion cylinder structure.

On an upper end of the outer cylindrical member 32 is mounted an outer top plate 48 of an annular shape which outwardly extends therefrom. The outer cylindrical member 32 is formed and arranged so as to terminate at an upper end thereof below upper ends of the inner cylindrical member 30 and heat-permeable cylinder 36. Accordingly, the outer top plate 48 extends toward a side surface of the heat-permeable cylinder 36. In the illustrated embodiment, it obliquely upwardly extends toward the heat-permeable cylinder 36. An outer end 50 of the outer top plate 48 is upwardly bent along the heat-permeable cylinder 40 and then outwardly bent at an upper end of the heat-permeable cylinder 36. When the outer top plate 48 is held on the heat-permeable cylinder 36 or on both the heat-permeable cylinder and outer cylindrical member 32, the outer end 50 of the outer top plate 48 is further bent in a downward direction along an outer surface of the heat-permeable cylinder 36.

Figure 2:
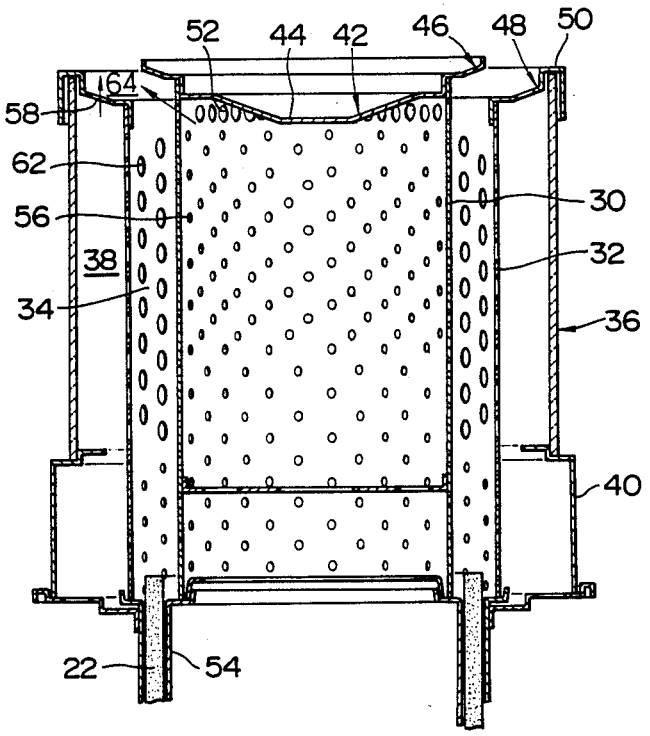
FIG. 2 is a fragmentary vertical sectional view showing an embodiment of a combustion cylinder structure according to the present invention.
Figure 3:
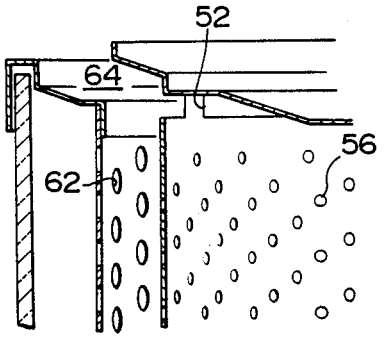
FIG. 3 is a fragmentary enlarged view in section showing an essential part of a modification of the combustion cylinder structure shown in FIG. 2.

The inner cylindrical member is densely or closely formed with a plurality of vent holes 52 at a section thereof vertically ranging from a portion of the inner top plate 42 mounted at the inner cylindrical member 30 to the central section 44 of the inner top plate 42. The vent holes 52 are preferably formed into a size larger than conventional through-holes 56 of the inner cylindrical member 30 arranged below the vent holes 52. The vent holes 52 may comprise a plurality of through-holes of a relatively large diameter in a row or in rows, as shown in FIG. 2. The through-holes 52 may be formed into a round shape. In the illustrated embodiment, they are formed into an elliptic shape. In FIG. 2, the through-holes 52 are arranged in a row for the sake of brevity. Alternatively, the vent holes 52 may comprise a plurality of slots arranged in a row as shown in FIG. 3. Air introduced from an ambient atmosphere through a central base cylinder 54 to the inner cylindrical member 30 is partially supplied from the through-holes 52 along an lower surface of the peripheral section or portion 46 of the inner top plate 42 to a region above the space 34 as detailedly described hereinafter.

Also, the inner cylindrical member 30 is formed with a plurality of small conventional through-holes 56 at a section thereof below the central section 44 of the inner top plate 42 as in the prior art. The through-holes 56 are preferably formed into a small size as compared with the vent holes 52 as shown in FIG. 2.

The outer top plate 48 is formed at a portion thereof between the inner cylindrical member 30 and the outer cylindrical member 32 with a plurality of through-holes 58 for vent holes, so that air introduced from an ambient atmosphere via through-holes or slits 60 of the cylindrical casing 26 to the second space 38 between the heat-permeable cylinder 36 and the outer cylindrical member 32 is guided via the through-holes 58 of the outer top plate 48 to the region above the space 34. In the illustrated embodiment, the through-holes are formed into a small round shape and arranged in rows. Alternatively, they may be formed into a slit-like shape.

Now, the manner of operation of the combustion cylinder structure of the illustrated embodiment constructed as described above will be described hereinafter with reference to the accompanying drawings.

When the wick 22 is raised to an ignited position or a lower portion of the first space 34 by means of the wick driving mechanism 20 as shown in FIG. 1 and is ignited by means of an ignition device (not shown), combustion starts in the lower portion of the space 34 surrounded by the heat-impermeable base cylinder 40 using air supplied via the through-holes 56 of the inner cylindrical member 30 and through-holes 62 of the outer cylindrical member 32 to the space 34, resulting in thermal decomposition of fuel oil gas into combustible gas and combustion of a part of the so-obtained combustible gas in the lower portion of the first space 34. Combustion is substantially carried out in the central and upper portions of the space 34 and an outer surface of the outer cylindrical member 32 surrounded by the heat-permeable cylinder 36 to red-heat the inner and outer cylindrical members 30 and 32. This results in the members 30 and 32 emitting heat rays, which are outwardly discharged through the heat-permeable cylinder 36 for space heating.

As described above, in the illustrated embodiment, the upper section of the combustion cylinder structure is so constructed that the outer cylindrical member 32 is arranged so as to terminate at its upper end below the upper ends of the inner cylindrical member 28 and heat-permeable cylinder 36 and the dish-like inner top plate 42 is formed into a diameter large sufficiently to cause its outer end or peripheral portion 46 to outwardly extend from the inner cylindrical member 30 to the position above the first space 34. Also, the inner cylindrical member 30 is formed at its upper portion opposite to the inner top plate 42 with the vent holes 52 in a dense or close manner. Such construction of the illustrated embodiment causes a part of air introduced into the inner cylindrical member 28 to be guided in a sufficient amount through the vent holes 52 along the lower surface of the inner top plate 42 to the region above the space 34 which region is a space 64 defined by cooperation of the outer top plate 48, the peripheral portion 46 of the inner top plate 42 and the heat-permeable cylinder 36.

Also, as described above, the outer cylindrical member 32 is formed into the smallest height, so that combustion gas produced due to combustion of combustible gas in the first space 34 is readily guided along the outer top plate 48 to the region or space 64. Further, the through-holes 58 of the outer top plate 48 permit air introduced into the space 38 to be supplied therethrough to the so-guided combustion gas.

Thus, combustible gas contained in the combustion gas is burned using air supplied as described above in the space 64 defined by cooperation of the outer top plate 48, the peripheral portion 46 of the inner top plate 42 and the heat-permeable cylinder 36, resulting in the outer top plate 48 and the peripheral portion 46 of the inner top plate 42 as well as the upper portion of each of the inner and outer cylindrical members being red-heated. The section of each of the cylindrical members positioned below the red-heated upper portion is red-heated as in the prior art.

Thus, it will be noted that the present invention ensures uniform red-heating of the whole inner and outer cylindrical members.

In addition, in the present invention, the inner top plate is not provided thereon with such an air regulating plate as used in the prior art, resulting in heat capacity of the inner top plate being significantly reduced. Also, the central portion 44 of the inner top plate 42 is positioned below the upper end of the inner cylindrical member 28, so that it is effectively red-heated by heat accumulated in the inner cylindrical member. Accordingly, the whole inner and outer top plates which are viewed through the heat-permeable cylinder are red-heated, so that space heating may be further promoted and a visual heating effect may be exhibited.

Furthermore, as described above, the present invention eliminates arrangement of an air regulating plate above the inner top plate as seen in the prior art. This leads to a significant decrease in manufacturing cost.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all the generic and specific features of the invention herein described and all statements of the scope of the invention which, as a matter of language, might be said to fall therebetween.

What is claimed is:

1. A combustion cylinder structure for an oil burner comprising:

a double combustion cylinder comprising an perforated inner cylindrical member and an perforated outer cylindrical member substantially concentrically arranged so as to define a space therebetween and red-heated during combustion operation of the oil burner;

an outermost cylinder arranged so as to surround said outer cylindrical member through a space defined therebetween and comprising a heat-permeable cylinder constituting middle and upper sections of said outermost cylinder and a heat-impermeable cylinder constituting a heat-permeable cylinder outwardly discharging heat rays emitted from said double combustion cylinder red-heated;

an inner top plate of a circular shape having a diameter larger than that of said inner cylindrical member and mounted on an upper end of said inner cylindrical member so as to outwardly extend at an outer periphery thereof from said inner cylindrical member;

said inner top plate being formed into a dish-like shape so as to have a peripheral section and a central section lower than said peripheral section;

said outer cylindrical member having an upper end terminating at a position below upper ends of said inner cylindrical member and outermost cylinder;

an outer top plate of an annular shape mounted on the upper end of said outer cylindrical member so as to extend from said outer cylindrical member to said outermost cylinder;

said inner cylindrical member being closely formed with a plurality of vent holes at a section thereof ranging from a portion of said inner top plate mounted at said inner cylindrical member to said central section of said inner top plate;

said outer top plate being formed at a portion thereof between said outer cylindrical member and said outermost cylinder with a plurality of through-holes.

2. A combustion cylinder structure as defined in claim 1, wherein said vent holes have a size larger than through-holes of said inner cylindrical member formed below said vent holes.

3. A combustion cylinder structure as defined in claim 2, wherein said vent holes each comprise a slit.

4. A combustion cylinder structure as defined in claim 3, wherein said vent holes are arranged in a row.

5. A combustion cylinder structure as defined in claim 2, wherein said vent holes each are formed into a round shape.

6. A combustion cylinder structure as defined in claim 5, wherein said vent holes each are formed into an elliptic shape.

7. A combustion cylinder structure as defined in claim 5, wherein said vent holes are arranged in rows.

8. A combustion cylinder structure as defined in claim 1, wherein said outer top plate obliquely upwardly extends to said outermost cylinder.

9. A combustion cylinder structure as defined in claim 8, wherein said outer top plate upwardly extends at an upper end thereof along an inner surface of said outermost cylinder.

10. A combustion cylinder structure as defined in claim 9, said upper end of said outer top plate further extends outwardly from the upper end of said outermost cylinder.

11. A combustion cylinder structure as defined in claim 10, wherein said upper end of said outer top plate is downwardly bent along an outer surface of said outermost cylinder.

* * * * *